United States Patent [19]
Braid
[11] 4,136,044
[45] Jan. 23, 1979

[54] LUBRICANT COMPOSITION CONTAINING ESTERS OF ARYLAMINOPHENOXYALKYL CARBOXYLIC ACIDS

[75] Inventor: Milton Braid, Westmont, N.J.

[73] Assignee: Mobil Oil Corporation, New York, N.Y.

[21] Appl. No.: 841,259

[22] Filed: Oct. 12, 1977

[51] Int. Cl.[2] ..... C10M 1/34; C10M 3/28; C09K 15/18; C07C 101/72

[52] U.S. Cl. ..... 252/51.5 A; 560/43; 252/403; 562/454

[58] Field of Search ..... 252/51.5 A, 403; 260/519; 560/43

[56] References Cited

U.S. PATENT DOCUMENTS

| | | | |
|---|---|---|---|
| 2,361,543 | 10/1944 | Hart et al. | 260/519 |
| 3,781,206 | 12/1973 | Braid | 252/51.5 A |
| 3,798,166 | 3/1974 | Braid | 252/51.5 A |
| 3,804,839 | 4/1974 | Dahm et al. | 260/45 |
| 3,890,301 | 6/1975 | Piasek et al. | 252/56 D |
| 3,984,337 | 10/1976 | Braid | 252/51.5 A |
| 4,036,772 | 7/1977 | Dorer, Jr. | 252/56 R |

*Primary Examiner*—Delbert E. Gantz
*Assistant Examiner*—Joan Thierstein
*Attorney, Agent, or Firm*—C. A. Huggett; Henry L. Ehrlich

[57] ABSTRACT

This specification discloses a lubricant composition containing esters of arylaminophenoxyalkyl carboxylic acids as an antioxidant and new compositions of matter useful as antioxidants.

20 Claims, No Drawings

LUBRICANT COMPOSITION CONTAINING ESTERS OF ARYLAMINOPHENOXYALKYL CARBOXYLIC ACIDS

BACKGROUND OF THE INVENTION

This invention relates to lubricant compositions containing antioxidants and to new compositions of matter that are useful as antioxidants.

Organic compositions such as mineral oils and lubricant compositions are subject to deterioration by oxidation and in particular are subject to such deterioration at high temperatures and when agitated in contact with air. Most lubricating oils, greases, and hydraulic fluids as well as many other organic compositions contain additives to inhibit the oxidation thereof.

In U.S. Pat. No. 3,492,234 to Harry J. Andress, Jr. et al, there is described organic compositions that contain polyalkylated napthols having up to 30 carbon atoms per alkyl group, which organic compositions possess high temperature antioxidant properties at temperatures of 600° F. and higher.

In U.S. Pat. No. 3,573,206 to Milton Braid et al, there is described lubricant compositions having improved antioxidant properties, which lubricant compositions contain oil-soluble products made by heating N-phenylnaphthylamine, N-naphthyl-naphthylamine, mixtures thereof, or mixtures thereof with diphenylamine, in the presence of an oxidizing agent.

In U.S. Pat. No. 3,919,095 to Abraham O. M. Okorodudu, there is described organic compositions that contain esters of phosphorodithioic acids to provide increased oxidative resistance and antiwear properties.

In U.S. Pat. No. 3,497,181 to Milton Braid there is described organic substances that are protected from oxidative deterioration by the presence therein of minor amounts of aryloxy(alkyloxy)alkane.

SUMMARY OF THE INVENTION

This invention is directed to a lubricant composition comprising a major amount of a lubricating oil or grease and a minor and sufficient amount of an arylaminophenoxyalkyl carboxylic acid ester to inhibit the oxidation of the lubricant composition.

DESCRIPTION OF THE PREFERRED EMBODIMENTS

Organic compositions into which minor amounts of the antioxidants of this invention may be incorporated include liquids and solids, minerals oils which are liquid products of petroleum within the viscosity range of products commonly called "oils", and lubricant compositions including oils and greases formed of mineral oils and synthetic oils. Other examples of organic liquids and solids which have use in industrial applications and which are subject to oxidative deterioration and into which the organic compositions of this invention may be incorporated are power transmission fluids, resin and polymer coatings, insulations and structural products.

The lubricant base of the lubricant composition of this invention may comprise liquid oils in the form of either a mineral oil or a synthetic oil or in the form of a grease in which any of the oils are employed as a vehicle. In general, mineral oils employed as a lubricant or grease vehicle may be of any suitable lubricating viscosity range such as, for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition after accounting for the desired quantity of the thickening agent and other additive components to be included in the grease formulation.

Typical synthetic oils which may be used in conjunction with this invention as lubricating oils or greases include polyisobutylene, polybutenes, hydrogenated polydecenes, polypropylene glycol, polyethylene glycol, trimethylol propane esters, neopentyl and pentaerythritol esters, di(2-ethyl hexyl) sebacate, di(2-ethyl hexyl) adipate, dibutyl phthalate, fluorocarbons, silanes, esters of phosphorous-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis(p-phenoxy phenyl) ether, and phenoxy phenyl ethers.

The novel compounds of this invention are the arylaminoaryloxyalkyl carboxylic acids represented by the structure I below, the esters thereof represented by the structure II below, and the polyesters thereof represented by the structure III below:

$$\mathrm{ArN(H)Ar'O(CH_2)_nC(=O)OH} \qquad \text{I}$$

Arylaminoaryloxyalkylcarboxylic acid $$\mathrm{ArN(H)Ar'O(CH_2)_nC(=O)OR} \qquad \text{II}$$

Esters of arylaminophenoxyalkylcarboxylic acids $$\mathrm{(ArN(H)Ar'O(CH_2)_nC(=O)O)_mR} \qquad \text{III}$$

Polyesters of arylaminoaryloxyalkylcarboxylic acids wherein:

Ar and Ar' are individually selected from the phenyl and naphthyl groups that may contain substituent groups such as alkyl and alkoxy groups;

R is selected from the group consisting of alkyl, aryl, alkaryl, and aralkyl hydrocarbyl groups containing 1 to 20 carbon atoms in any isomeric constitution and may contain substituent groups such as alkoxy, alkoxyalkyl, acyloxy, acyloxyalkyl, and carbalkoxy;

m is a whole number within the range of 1 to 6; and n is a whole number within the range of 1 to 12.

Compounds that are esters of arylaminophenoxyalkylcarboxylic acids as illustrated by structure II are prepared by the reaction of an ω-haloalkylcarboxylic acid ester with a hydroxy-substituted diarylamine in a suitable solvent such as N,N-dimethylformamide, N,N-dimethylacetamide, dimethylsulfoxide in the presence of anhydrous potassium or sodium carbonate. The corresponding acids, as illustrated by the structure I, are prepared by hydrolysis of the esters of structure II. The polyesters of arylaminoaryloxyalkylcarboxylic acids represented by the structure III are formed by esterification or transesterification of the appropriate arylaminoaryloxyalkylcarboxylic acid, structure I, or esters thereof, structure II, by using polyhydric alcohols such as ethylene glycol, trimethylolpropane, pentaerythritol and partially or completely esterified derivatives of these, di- and trimethylolphenol, and benzenedimethanol.

The compounds of this invention are particularly applicable as oxidative inhibitors in ester base lubricants such as the $C_5$ and $C_9$ carboxylic acid esters of hydrocarbons selected from the group consisting of pentaerythritol and trimethylolpropane. The compounds of this invention may be incorporated by transesterification of the arylaminoaryloxyalkylcarboxylic acids, structure I, with an ester base stock and the acids, for example, the $C_5$ and $C_9$ acids which are liberated, are removed by distillation. Lubricants are thus provided wherein the oxidative inhibitor esters of this invention are incorporated as an integral part of the ester base stock.

In accordance with a method of this invention, oxidative protection is provided for such an ester base lubricant containing $C_5$ and $C_9$ carboxylic acid esters of hydrocarbons selected from the group consisting of pentaerythritol and trimethylolpropane by treating the lubricant by partial transesterification with an ester represented by the formula:

$$\mathrm{ArNHAr'O(CH_2)_n\overset{O}{\overset{\|}{C}}OR}$$

wherein:

Ar and Ar' are individually selected from the phenyl and naphthyl groups;

R is an alkyl group having from 1 to 6 carbon atoms, examples of such alkyl groups include methyl, ethyl, propyl, isopropyl, butyl, isobutyl, and sec-butyl; and n is a whole number within the range of 1 to 12;

and thereafter treating the lubricant by distillation to complete the transesterification by removing the $C_5$ and $C_9$ carboxylic acid esters of R liberated during the transesterification treatment of the lubricant.

The oxidative inhibitor esters of this invention may be incorporated into an ester base stock to form an integral part of the ester base stock by esterification of arylaminophenoxyalkylcarboxylic acids, structure I, with pentaerythritol or trimethylolpropane after which esterification is completed with alkylcarboxylic acids. In accordance with another method of this invention, oxidative protection is provided for the ester base lubricant by treating the lubricant with a substituted carboxylic acid represented by the formula:

$$\mathrm{ArNHAr'O(CH_2)_n\overset{O}{\overset{\|}{C}}OH}$$

wherein:

Ar and Ar' are individually selected from the phenyl and naphthyl groups; and n is a whole number within the range of 1 to 12;

to esterify the lubricant, partially or completely. The lubricant may further be treated with $C_5$ and $C_9$ carboxylic acids to ensure completion of the esterification.

The antioxidants of this invention as illustrated by structure III also may be synthesized as individual chemicals and added to lubricant base stocks or other organic compositions to provide oxidation protection thereto. These antioxidants are particularly adaptable for use in ester base stocks such as gas turbine engine lubricants and mixed ester-refined petroleum based lubricants. They may be included in lubricants in concentrations of about 0.1 percent by weight to about 10 percent by weight, and preferably in concentrations of about 0.25 percent to 5 percent by weight to provide oxidation protection thereto. These preferred concentrations provide sufficient oxidation protection for lubricant compositions under uses normally anticipated.

Catalytic oxidation tests were carried out to evaluate the compounds of this invention as oxidative inhibitors. These tests involved comparing the stability of a base stock of $C_5$ and $C_9$ esters of pentaerythritol with and without the compounds of this invention when exposed to oxidizing conditions at test temperatures of 450° F. for a test period of 24 hours in the presence of metal catalysts.

Catalytic Oxidation Test

In carrying out the catalytic oxidation test, a 25 ml. test sample in a glass apparatus is placed in a heating bath at the desired temperature. Present in the sample are the following materials which are either known to catalyze oxidation of organic substances, or are commonly used materials of construction, in an amount sufficient to provide the specified exposed surface area as indicated below:

(a) 15.6 square inches of sand-blasted iron wire;
(b) 0.78 square inch of polished copper wire;
(c) 0.87 square inch of polished aluminum wire; and
(d) 0.167 square inch of polished lead surface.

Dry air is passed through the heated sample at the rate of about 5 liters per hour for the specified duration of the test.

At the conclusion of the test, the increase in the acidity (N,N) and kinematic viscosity (KV) resulting from the oxidation is measured. In addition, the loss in weight of the lead specimen is determined as an indication of corrosion and relative amounts of visual sludge are observed.

The results of these tests are given in TABLE I below:

TABLE I

24Hr., 450 ° F., $C_5$ and $C_9$ esters of pentaerythritol base stock

| Additive of Example No. | Conc. Wt. % | ΔNN | ΔKV % | Pb Loss mg. | Sludge |
|---|---|---|---|---|---|
| None | — | 8.25 | 586 | 13.7 | Trace |
| 1. 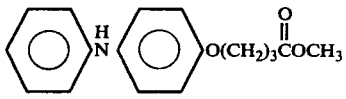 | 2 | 3.5 | 139 | 4 | Light |
| | 1 | 5.1 | 225 | 3.7 | Trace |

TABLE I-continued

| Additive of Example No. | Conc. Wt. % | ΔNN | ΔKV % | Pb Loss mg. | Sludge |
|---|---|---|---|---|---|
| 24Hr., 450 ° F., $C_5$ and $C_9$ esters of pentaerythritol base stock | | | | | |
| Methyl 4-(p-anilinophenoxy)butyrate | | | | | |
| 2. Pentaerythritol ester of 4-(p-anilino-phenoxy)butyric acid | 2 | 5.3 | 241 | 3.9 | Moderate |
| 3. Transesterification product of Example 1 with trimethylol propane | 2 | 0.7 | 39 | 8.9 | Trace |
| | 1 | 2 | 64 | 6.7 | Trace |
| 4. Product of Example 3 transesterified with methyl hexanoate | 2 | 4.1 | 88 | 6.2 | Moderate |
| | 1 | 6.3 | 156 | 10.5 | Moderate |
| 5. N-Phenyl-1-naphthyl-amine | 2 | 3.6 | 82 | 0.2 | Light |
| 6. Example 1 + co-additive of Example 5 | 1 / 1 | 2.6 | 99 | 2.3 | Light |
| 7. Example 2 + co-additive of Example 5 | 1 / 1 | 3.3 | 68 | 12.5 | Light |

The nomenclature for the additive of Example No. 3 is a partial trimethylolpropane ester of 4-(p-anilinophenoxy)butyric acid, and that of Example No. 4 is a mixed-(p-anilinophenoxy)butyrate and hexanoate esters of trimethylolpropane.

It is shown by TABLE I and the examples which follow that the products of the examples are polyesters of arylaminoaryloxyalkylcarboxylic acids as illustrated by the general structure III previously described. In Example 1 the product is an ester of anilinophenoxybutric acid and in the structure III n is 3, m is 1, and R is a methyl group. In Example 2, n is 3, m is 4, and R is a pentaerythrityl group. In Example 3, n is 3, m is about 3, and R is mainly 2,2-dimethylenebutyl. In Example 4, n is 3, m is about 2, and R is mainly 1-methylene-1-hexanoyloxymethylbutyl group.

This invention is further illustrated by the following examples.

EXAMPLE 1

Methyl 4-(p-anilinophenoxy)butyrate

A mixture of 198 g. of methyl 4-chlorobutyrate, 269 g. of p-anilinophenol, and 636 g. of anhydrous potassium carbonate, all in 500 ml. of N,N-dimethylformamide was heated at 140° C. while stirring for 4 hours and about 300 ml. of the N,N-dimethylformamide was removed by distillation. The residue was poured into ice water and the resulting mixture was extracted with benzene. The dried benzene extract was chromatographed through a column of neutral alumina and the benzene solvent was stripped from the eluent leaving the product, methyl 4-(p-anilinophenoxy)butyrate, as a dark amber liquid. This ester was sufficiently pure to be used as an antioxidant. Crystallization of the crude ester from ethanol afforded a solid, mp. 40°–41° C.

Anal. Calc'd. for $C_{17}H_{19}O_3N$: C, 71.56; H, 6.71; N, 4.91. Found: C, 71.02; H, 6.69; N, 4.97.

EXAMPLE 2

A mixture of 3.4 g. of pentaerythritol, 27.1 g. of 4-(p-anilinophenoxy)butyric acid, and 0.2 g. of p-toluenesulfonic acid was heated at 110° while stirring in 200 ml. of toluene during 3.5 hours. The temperature was raised by adding 150 ml. of xylene and distilling the toluene and the reaction temperature was then held at 129°–132° C. for 1.5 hours after which gas chomatography confirmed that no unreacted pentaerythritol remained. The reaction was washed with aqueous potassium carbonate solution and then water. Solvent was removed by distillation after drying and the residue was crystallized as a waxy solid from methanol. The waxy solid was extracted with ethyl acetate and filtered. Solvent was stripped from the filtrate leaving the pentaerythrityl 4-(p-anilinophenoxy)butyrate ester as a slightly viscous brownish oil.

EXAMPLE 3

Methyl 4-(p-anilinophenoxy)butyrate (4.4 g.) prepared by the method of Example 1 and 1,1,1-trimethylolpropane (28.5 g.) were heated together at 170° C. in the presence of 0.1 g. each of sodium metal and aluminum isopropylate for several hours. The reaction mixture was cooled, taken up in ether, and the ether solution was then washed with aqueous sodium bicarbonate solution and then water. Solvent was distilled from the dried ether solution leaving the 4-(p-anilinophenoxy)butyrate ester of 1,1,1-trimethylolpropane as a dark brown viscous liquid. The infrared spectrum of this ester showed a small amount of hydroxyl absorption indicating that esterification was not quite complete.

EXAMPLE 4

The 1,1,1-trimethylolpropane ester of Example 3 (20.3 g.) and methyl hexanoate (40 g.) were heated together with catalytic amounts of sodium metal and aluminum isopropylate at 162°–165° for several hours. The reaction product was washed with aqueous sodium bicarbonate and then with water. After drying, unreacted methyl hexanoate was removed by distillation leaving the mixed 4-(p-anilinophenoxy)butyrate and hexanoate ester of 1,1,1-trimethylolpropane as a dark slightly viscous residue.

EXAMPLE 5

Methyl 4-(p-anilinophenoxy)butyrate prepared by the method of Example 1 was hydrolyzed in a mixture of aqueous potassium carbonate and N,N-dimethylformamide. The reaction mixture was acidified with hydrochloric acid and the solids precipitated thereby were collected and recrystallized from ethanol. The 4-(p-anilinophenoxy)butyric acid thus obtained was a greyish crystalline solid, m.p. 110°–111° C.

Anal. Calc'd for $C_{16}H_{17}O_3N$: C, 70.83; H, 6.32; N, 5.16. Found: C, 70.54; H, 5.91; N, 5.08.

The acid was suitable for acid catalyzed esterification with mono- and polyhydric alcohols.

I claim:

1. A lubricant composition comprising a major amount of a lubricating oil or grease and a minor amount sufficient to inhibit the oxidation thereof of an ester of arylaminophenoxyalkylcarboxylic acid represented by the formula:

$$(\overset{H}{\text{Ar}}\text{NAr'O}(\text{CH}_2)_n\overset{O}{\overset{\|}{\text{C}}}\text{O})_m\text{R}$$

wherein:

Ar and Ar' are individually selected from the phenyl and naphthyl groups;

R is selected from the group consisting of alkyl, aryl, alkaryl, and aralkyl hydrocarbyl groups containing 1 to 20 carbon atoms in any isomeric constitution and may contain substituent groups such as alkoxy, alkoxyalkyl, acyloxy, acyloxyalkyl, and carbalkoxy;

m is a whole number within the range of 1 to 6; and n is a whole number within the range of 1 to 12.

2. The composition of claim 1 wherein n is a whole number within the range of 2 to 6.

3. The composition of claim 1 wherein R is an alkyl group containing from 1 to 6 carbon atoms, n is 3, and m is 1.

4. The composition of claim 1 wherein R is a methyl group, n is 3, and m is 1.

5. The composition of claim 1 wherein R is a pentaerythrityl group, n is 3, and m is 4.

6. The composition of claim 1 wherein R is a 1,1-dimethylenebutyl group, n is 3, and m is 3.

7. The composition of claim 1 wherein R is 1-methylene-1-hexanoyloxymethylbutyl group, n is 3, and m is 2.

8. A lubricant composition comprising a major amount of a lubricating oil or grease and a minor amount sufficient to inhibit the oxidation thereof of a mixture of methyl 4-(p-anilinophenoxy)butyrate and N-phenyl-1-naphthylamine.

9. A lubricant composition comprising a major amount of a lubricating oil or grease and a minor amount sufficient to inhibit the oxidation thereof of a mixture of pentaerythritol ester of 4-(p-anilinophenoxy)butyric acid and N-phenyl-1-naphthylamine.

10. A method of providing oxidative protection to an ester base lubricant comprising incorporating a substituted carboxyl group represented by the formula $$\text{ArNHAr'O}(\text{CH}_2)_n\overset{O}{\overset{\|}{\text{C}}}\text{O}^-$$

wherein:

Ar and Ar' are individually selected from the phenyl and naphthyl groups; and n is a whole number within the range of 1 to 12, via transesterification into said lubricant and thereafter treating said lubricant to remove liberated acids and esters.

11. The method of claim 10 wherein said lubricant contains $C_5$ and $C_9$ carboxylic acid esters of hydrocarbons selected from the group consisting of pentaerythritol and trimethylolpropane and further wherein said acids liberated from said esters are removed by distillation.

12. A method of providing oxidative protection to an ester base lubricant containing $C_5$ and $C_9$ carboxylic acid esters of hydrocarbons selected from the group consisting of pentaerythritol and trimethylolpropane comprising:

(a) treating said lubricant by partial transesterification with an ester represented by the formula:

$$\text{ArNHAr'O}(\text{CH}_2)_n\overset{O}{\overset{\|}{\text{C}}}\text{OR}$$

wherein:

Ar and Ar' are individually selected from the phenyl and naphthyl groups;

R is an alkyl group having from 1 to 6 carbon atoms; and n is a whole number within the range of 1 to 12;

(b) thereafter treating said lubricant by distillation to complete the transesterification by removing the formed $C_5$ and $C_9$ carboxylic acid esters of R.

13. A method of providing oxidative protection to an ester base lubricant containing $C_5$ and $C_9$ carboxylic acid esters of hydrocarbons selected from the group consisting of pentaerythritol and trimethylolpropane comprising:

(a) treating said ester base lubricant with a substituted carboxylic acid represented by the formula:

$$\text{ArNHAr'O}(\text{CH}_2)_n\overset{O}{\overset{\|}{\text{C}}}\text{OH}$$

wherein:

Ar and Ar' are individually selected from the phenyl and naphthyl groups; and n is a whole number within the range of 1 to 12; to esterify said lubricant; and (b) thereafter treating said lubricant with $C_5$ and $C_9$ carboxylic acids to ensure complete esterification thereof.

14. A compound of the formula:

$$(\overset{H}{\text{Ar}}\text{NAr'O}(\text{CH}_2)_n\overset{O}{\overset{\|}{\text{C}}}\text{O})_m\text{R}$$

wherein:

Ar and Ar' are individually selected from the phenyl and naphthyl groups;

R is selected from the group consisting of alkyl, aryl, alkaryl, and aralkyl hydrocarbyl groups containing 1 to 20 carbon atoms in any isomeric constitution and may contain substituent groups such as alkoxy, alkoxyalkyl, acyloxy, acyloxyalkyl, and carbalkoxy;

m is a whole number within the range of 1 to 6; and n is a whole number within the range of 1 to 12.

15. The compound of claim 14 wherein n is a whole number within the range of 2 to 6.

16. The compound of claim 14 wherein R is a methyl group, n is 3, and m is 1.

17. The compound of claim 14 wherein R is a pentaerythrityl group, n is 3, and m is 4.

18. The compound of claim 14 wherein R is a 1,1-dimethylenebutyl group, n is 3, and m is 3.

19. The compound of claim 14 wherein R is 1-methylene-1-hexanoyloxymethylbutyl group, n is 3, and m is 2.

20. The method of claim 10 wherein said ester base lubricant is a carboxylic acid ester base lubricant.

* * * * *